US007527527B2

(12) United States Patent
Morlion et al.

(10) Patent No.: US 7,527,527 B2
(45) Date of Patent: May 5, 2009

(54) CONNECTOR SYSTEM FOR CONNECTING A FIRST PART AND A SECOND PART, CONNECTOR ASSEMBLY AND DEVICE BOARD

(75) Inventors: Danny Louis Cornelius Morlion, Gent (BE); Stefaan Hendrik Josef Sercu, JW Velddriel (NL)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/080,738

(22) Filed: Apr. 4, 2008

(65) Prior Publication Data

US 2008/0214056 A1 Sep. 4, 2008

Related U.S. Application Data

(62) Division of application No. 10/523,903, filed as application No. PCT/EP2003/050327 on Jul. 22, 2003, now abandoned.

(30) Foreign Application Priority Data

Aug. 5, 2002 (NL) ..... 1021208

(51) Int. Cl.
*H01R 24/00* (2006.01)

(52) U.S. Cl. ..... 439/620.22

(58) Field of Classification Search ..... 439/76.1, 439/620.21, 620.22, 218
See application file for complete search history.

(56) References Cited

U.S. PATENT DOCUMENTS

| | | | | |
|---|---|---|---|---|
| 5,037,313 | A | 8/1991 | Linden et al. | 439/76 |
| 5,043,949 | A | 8/1991 | Shechter | 367/76 |
| 5,118,300 | A | 6/1992 | Zarreii | 439/79 |
| 5,177,404 | A | 1/1993 | Cohen et al. | 315/154 |
| 5,769,645 | A | 6/1998 | Martin et al. | 439/79 |
| 6,047,379 | A | 4/2000 | Larabell et al. | 713/300 |
| 6,126,463 | A | 10/2000 | Okazaki et al. | 439/188 |
| 6,160,485 | A | 12/2000 | Krakovich | 340/635 |
| 6,379,184 | B1 | 4/2002 | Bassler et al. | 439/607 |
| 6,496,626 | B2 | 12/2002 | Spagnoletti et al. | 385/101 |
| 6,561,849 | B2 | 5/2003 | Naito et al. | 439/607 |
| 6,796,806 | B2 | 9/2004 | Boutros et al. | 439/76.1 |

FOREIGN PATENT DOCUMENTS

| | | |
|---|---|---|
| EP | 1 220 376 A2 | 7/2002 |
| JP | 11176519 | 7/1999 |
| WO | WO 97/06514 | 2/1997 |
| WO | WO 02/17053 A1 | 8/2000 |

*Primary Examiner*—Neil Abrams
(74) *Attorney, Agent, or Firm*—Harrington & Smith, PC

(57) ABSTRACT

An assembly including a first electrical component and either a first electrical cable assembly or an alternative second electrical cable assembly. The first electrical component includes a first electrical connector having a first non-signal contact adapted to be connected to a power supply line. The first cable assembly includes a first electrical cable having a first length and a second electrical connector. The second electrical connector includes a second non-signal contact and an active electronic circuit, wherein the active electronic circuit is powered, in operation, by the power supply line of the first electrical component through the non-signal contacts. The second cable assembly includes a second electrical cable having a second shorter length and a third electrical connector, wherein the third electrical connector includes a third non-signal contact which can be connected to the first non-signal contact, wherein the third electrical connector does not comprise the active electronic circuit.

18 Claims, 3 Drawing Sheets

Figure 1:
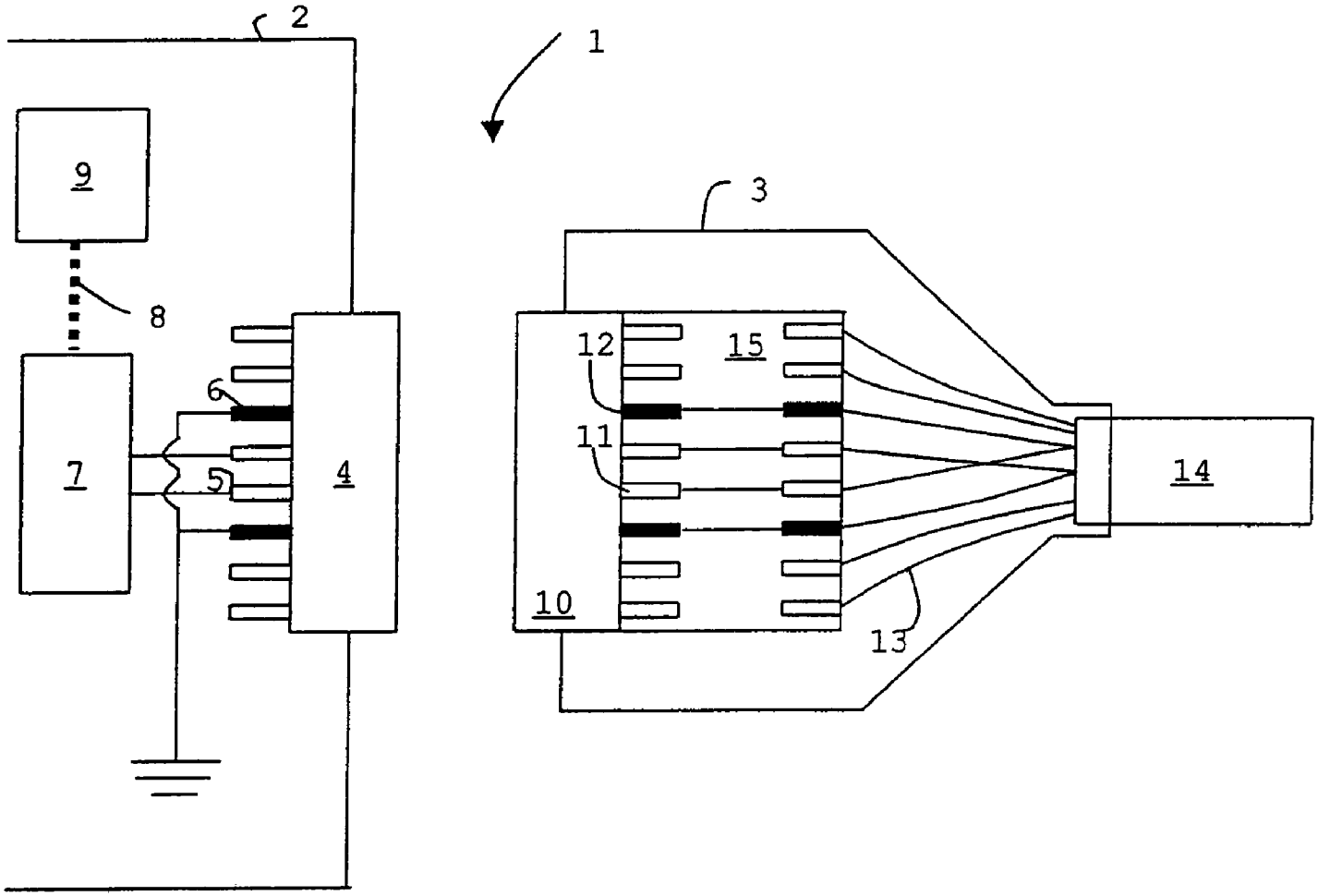
PRIOR ART Fig. 1

CONNECTOR SYSTEM FOR CONNECTING A FIRST PART AND A SECOND PART, CONNECTOR ASSEMBLY AND DEVICE BOARD

CROSS REFERENCE TO RELATED APPLICATION

This is a divisional patent application of application No. 10/523,903 filed Aug. 19, 2005, and now abandoned which is a national stage patent application of International Application No. PCT/EP2003/050327 filed Jul. 22, 2003 which claims priority on Netherlands patent application No. 1021208 filed Aug. 5, 2002.

The invention relates to a connector system for a first part and a second part, wherein:

said first part comprises a, power supply line, a plurality of signal contacts and a plurality of ground contacts said second part comprises a plurality of corresponding signal contacts and a plurality of corresponding ground contacts It is well known that signals that are transmitted over a cable will degrade with regard to their initial characteristics. This degradation may depend on several factors, such as the length of the cable over which the signals are transmitted or the frequency of the signals being transmitted.

To account for this degradation behaviour, signals are manipulated to improve the overall quality of the transmitted signal. In a simple approach, manipulation of the signals is achieved by using passive compensation. In this approach electronic circuits comprising passive components such as resistors, capacitors and inductors are used. These passive components may be applied on e.g. a device board or printed circuit board (PCB's). Alternatively, the passive components can be applied in a connector assembly at the side intended to mate with the device board for transmitting the signals.

However, in many circumstances passive compensation is inadequate to maintain the quality of the transmitted signals at the required level. This may e.g. be the case if the length of the cable that transmits the signals exceeds a certain limit. In such a case, active compensation is required. Active compensation is a known technique for manipulating signals. Electronic circuits, performing active compensation tasks, are conventionally applied at the device board. The power for such an electronic circuit for performing these compensation tasks is acquired from a power source on the device board.

Since it is not known beforehand what type of cable, with respect to e.g. the cable length, is going to be connected to the device board, the prior art approach is to apply an active compensation circuit on the device board to allow any connection of any type of cable. This approach is rather inefficient and expensive.

It is an object of the invention to provide a solution for these and other problems of the prior art.

This object is achieved by providing a connector system for a first part and a second part, characterised in that said power supply line is connected to at least one ground contact of said first part and extended into said second part by a connection between said ground contact and a corresponding ground contact of said second part. By implementing the electronic circuit for active compensation in the second part (e.g. a connector assembly), the first part (e.g. the device board) may be designed without the active compensation circuit. Only when active compensation is actually required, an electronic circuit for performing active compensation tasks has to be applied in the second part. The electronic circuit in the second part is powered via the power supply line from the first part via suitable ground contacts of the first and second part. The invention thus involves a more efficient and less expensive approach with regard to signal manipulation. The cable assembly may comprise also electronic circuits that manipulate or process the signal on transmitting or receiving such a signal.

In an embodiment of the invention the first part is a PCB or device board and the second part is a connector assembly for transmitting signals over a cable to a third part. This third part may be another PCB or device board. The cable assembly may comprise electronic circuits powered according to the invention on both sides.

In an embodiment of the invention the connector assembly is adapted to isolate said power supply line from said cable. This ensures that, while a voltage is applied to the electronic circuit in the cable connector, the cable does not transmit the voltages further as to avoid dangerous situations or conflicts with regulatory requirements.

The invention also relates to a connector assembly for use in such as system. The connector assembly comprising an electronic circuit is adapted as to receive a voltage from a power supply line in the first part via a suitable ground pin. The arrangement is such that this voltage is not carried further in the cable to a third part.

The invention also relates to a device board for use in a connector system. At least one of the ground pins of such a device board or connector thereof is dedicated to be fed by a power supply line as to provide power to a cable connector or assembly.

U.S. Pat. No. 5,037,313 discloses an active plug-in part comprising an electronic circuit in a cable connector. The publication however does not disclose how the electronic circuit is powered.

Figure 2:
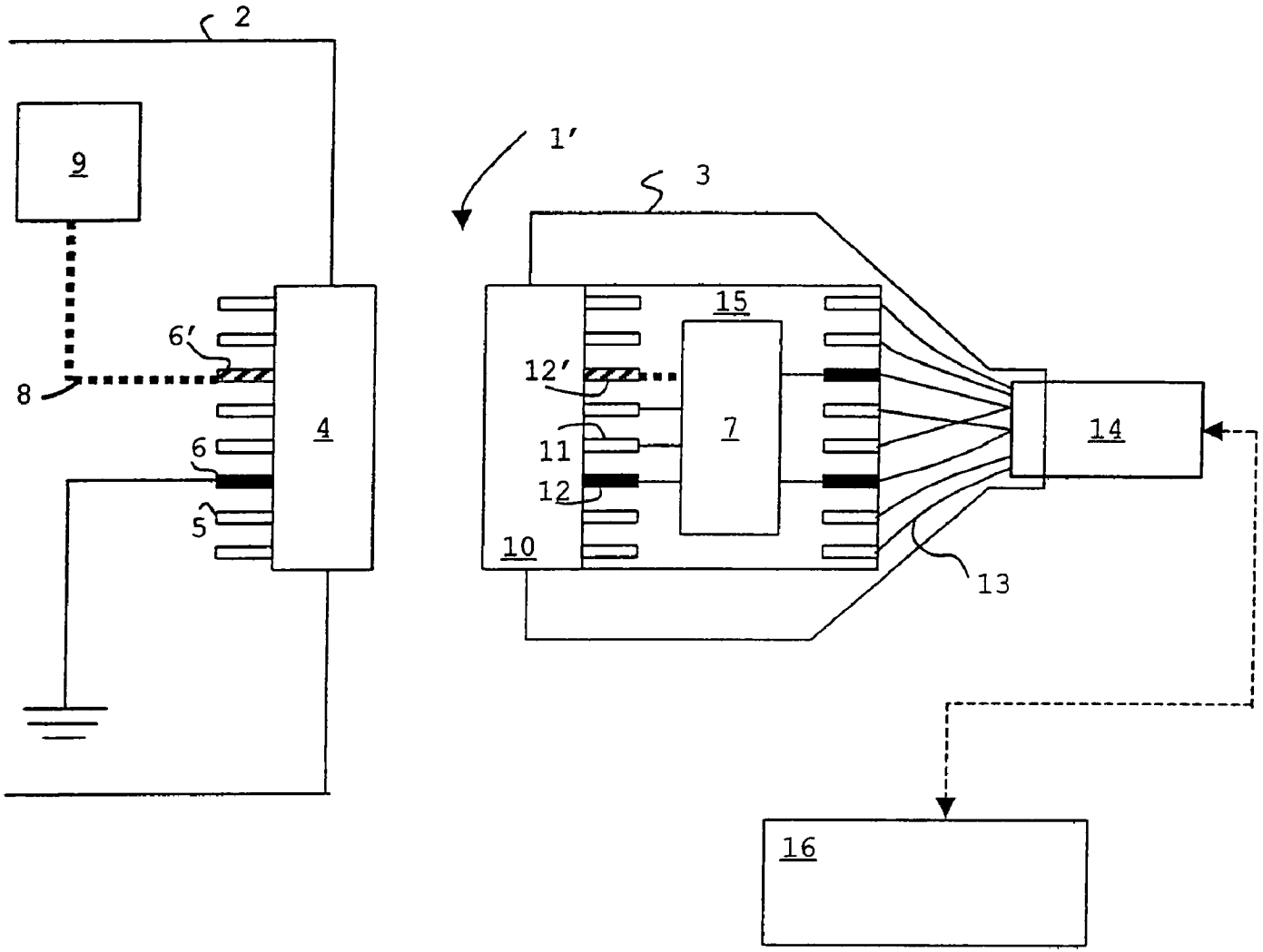

The embodiments of the invention will be described into more detail below with reference to the attached drawing of which FIG. 1 schematically illustrates a connector system for a device board and a connector assembly according to the prior art;

FIG. 2 schematically illustrates a connector system for a device board and a connector assembly comprising an electronic circuit according to an embodiment of the invention.

Figure 3:
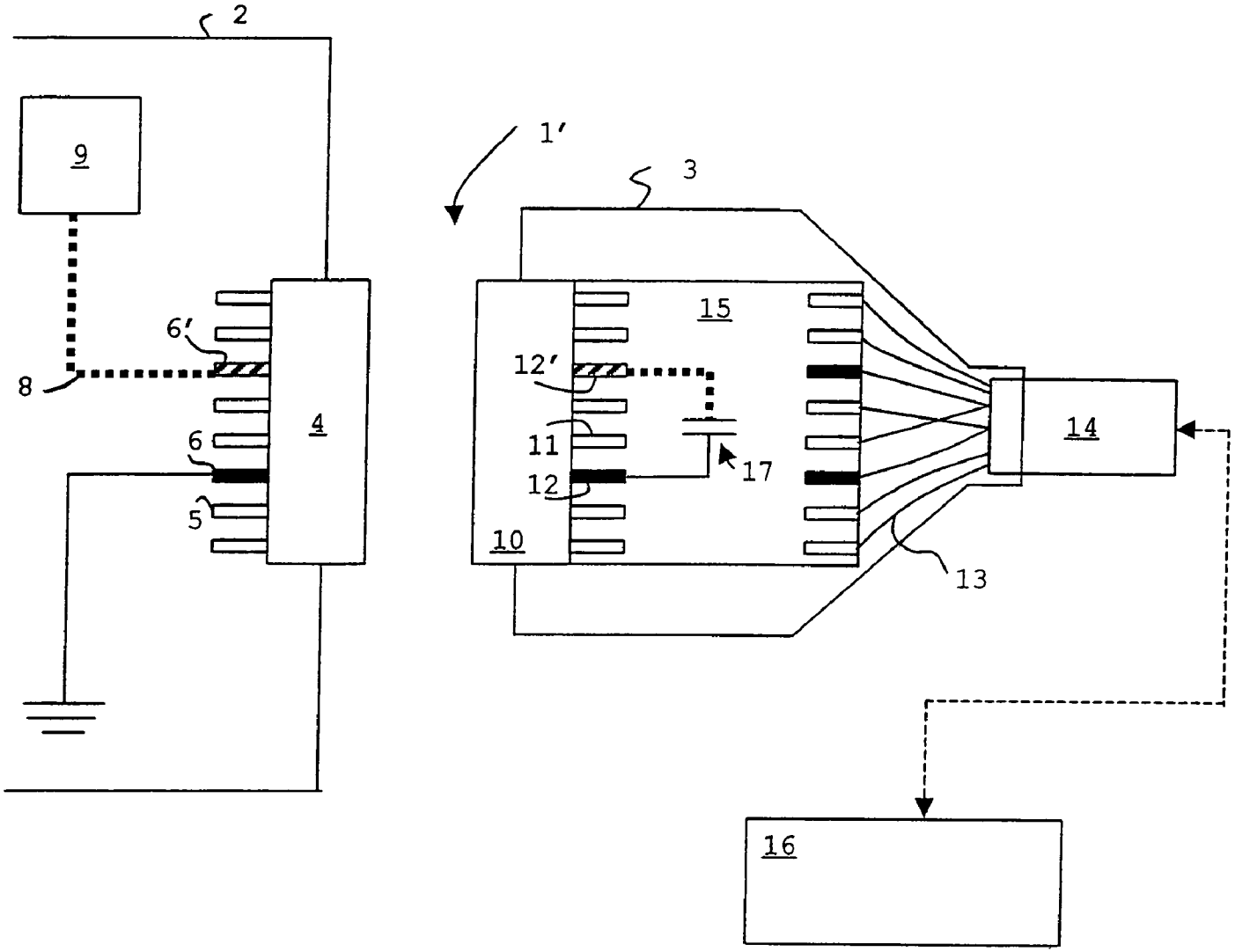

FIG. 3 schematically illustrates a connector system for a device board and a connector assembly without an electronic circuit according to an embodiment of the invention.

In FIG. 1 a system 1 for connecting a first part 2 and a second part 3 is shown according to the prior art. The first part 2 will hereinafter be referred to as device board 2. The second part 3 will hereinafter be referred to as connector assembly 3. Device board 2 comprises a connector 4, comprising signal contacts 5 and ground contacts 6. The signals from the device board 2 can be manipulated by the electronic circuit 7. This electronic circuit 7 performs active compensation tasks for signals to be transmitted through the connector assembly 3. The electronic circuit 7 is powered over the power supply line 8, indicated by the thick dashed line, by the voltage source 9 present at the device board side. It is noted that the voltage source 9 is not necessarily an integral part of the device board 2.

The connector assembly 3 comprises a connector 10 comprising signal contacts 11 corresponding to the signal contacts 5 of the device board 2 and ground contacts 12 corresponding to the ground contacts 6 of the device board 2. The contacts 11 and 12 are connected via wires 13 and are connected to the cable 14. In most cases a board or card 15 is provided to connect the contacts 11 and 12 with the wires 13 of the cable 14.

In FIG. 2 a system 1' for connecting a first part 2 and a second part 3 according to an embodiment of the invention are shown. Parts of the system 1' that are similar or identicated to the parts displayed for the system 1 in FIG. 1 are indicated by the same reference numerals.

In the embodiment of the invention the electronic circuit 7 is part of the connector assembly 3, e.g. by accommodating the electronic circuit 7 on a board or card 15 mounted to or within the connector assembly 3 or cable connector 10. The electronic circuit 7 is powered from the voltage source 9 by assigning or dedicating at least one of the ground contacts 6 for connection to the power supply line 8. This contact 6' of connector 4 of the device board 2 has a corresponding contact 12' for extending the power supply line 8 into the connector assembly 3 as to apply the voltage to the electronic circuit 7. The voltage supply path 8 is indicated by the thick dashed line in FIG. 2. The other ground contacts 6 and corresponding ground contacts 12 remain to be used for grounding purposes. Moreover, FIG. 2 illustrates that the power supply line is isolated from the wires 13 of the cable 14 to avoid the wires 13 to carry a substantive voltage over the cable 14 to a third part 16.

In operation of the system 1', the device board 2 and connector assembly 3 are connected to each other by connecting the connectors 4 and 10 such that the signal contacts 5 and 11 and the ground contacts 6 and 12 meet. In that case the contacts 6' and 12' also connect as a result of which the voltage source 9 is connected to the electronic circuit 7 via the power supply line 8 that extends into the connector assembly 2. Thus, the electronic circuit 8 is powered from the device board 2.

Since the electronic circuit 7 is powered, signals transmitted over the signal contacts 5 and 11 can be manipulated in order to optimise these signals and transmit them to e.g. the third device 16. The electronic circuit 8 may e.g. be an active equalisation device. Connector assemblies comprising such active compensation devices only have to be applied if e.g. the length of cable 14 exceeds a certain limit. It is noted that the electronic circuit may comprise passive components.

In FIG. 3 the situation is illustrated wherein the board 15 does not comprise an electronic circuit 7. However, the device board 2 still connects the power supply line 8 to the ground contact 6' thereby extending the power supply line via the corresponding ground contact 12' into the cable assembly 3. In such a case the cable assembly 3 for the cable 14 may still be used, since the board 15 of the cable assembly 3 may comprise e.g. a capacitor 17 grounded via the remaining ground contacts 12 and 6 at the ground of e.g. the device board 2. As an alternative the corresponding ground contact 12' is isolated in the cable assembly 3.

For the purpose of teaching the invention, a preferred embodiment of the system for transmitting signals and a connector have been described above. It will be apparent for the person skilled in the art that other alternative and equivalent embodiments of the invention can be conceived and reduced to practice without departing from the true spirit of the invention.

The invention claimed is:

1. An assembly comprising:

a first electrical component comprising a first electrical connector adapted to be connected to a power supply line from a voltage source and, wherein the first electrical connector comprises a first non-signal contact adapted to be connected to the power supply line and a plurality of signal contacts; and a cable assembly adapted to be connected to the first electrical connector, wherein the cable assembly comprises:

a first cable assembly comprising a first electrical cable and a second electrical connector at an end of the first electrical cable, wherein the first cable comprises a first length, wherein the second electrical connector comprises a plurality of signal contacts, a second non-signal contact and an active electronic circuit inside the second electrical connector which is connected to the second non-signal contact, wherein the active electronic circuit is powered, in operation, by the power supply line of the first electrical component through the non-signal contacts, and an alternative second cable assembly comprising a second electrical cable and a third electrical connector at an end of the second electrical cable, wherein the second cable has a second length which is shorter than the first length of the first electrical cable, wherein the third electrical connector comprises a third non-signal contact and a plurality of signal contacts, wherein the third non-signal contact is connected to the first non-signal contact when the second cable assembly is connected to the first electrical connector, wherein the third electrical connector does not comprise the active electronic circuit, wherein the first and second cable assemblies are adapted to be alternatively connected to the first electrical connector of the first electrical component to accommodate different distances between the first electrical component and another electrical component without substantially poorer signal quality between the electrical components and without unnecessary use of the active electronic circuit when the distance between the electrical components allows the relatively shorter length of the second cable to be used.

2. An assembly as in claim 1 wherein the first electrical component comprises the power supply line from the voltage source.

3. An assembly as in claim 2 wherein the first electrical component comprises the voltage source.

4. An assembly as in claim 1 wherein the active electronic circuit comprises an active equalization device adapted to improve quality of signals transmitted from the first electrical connector to the second electrical connector, wherein the active equalization device is powered, in operation, by the power supply line through the non-signal contacts.

5. An assembly as in claim 1 wherein the first and second cable assemblies are adapted to be alternatively connected to the first electrical connector of the first electrical component to allow voltage from the power supply line and the first non-signal contact to be used with the first length cable and the active electronic circuit when the first cable assembly is connected to the first electrical component, or alternatively still connect the first non-signal contact to a non-signal contact in the third electrical connector but not use voltage from the power supply line and the first non-signal contact with the second shorter length cable when the second cable assembly is connected to the first electrical component.

6. An assembly as in claim 1 wherein the first electrical connector is directly on a device board of the first electronic component.

7. An assembly as in claim 1 wherein the first electrical connector comprises at least a portion of a device circuit board of the first electronic component.

8. An assembly as in claim 1 wherein the second electrical connector is adapted to be directly connected to the first electrical connector, and wherein the second cable extends directly away from the second electrical connector.

9. An assembly as in claim 1 wherein the second non-signal contact is solely dedicated to supply power to the active electronic circuit inside the second electrical connector, and wherein the second and third electrical connectors prevent substantive voltage from the non-signal contacts from being carried by the cables.

10. An assembly as in claim 1 wherein the first electrical component comprises a device circuit board forming at least a portion of the power supply line, wherein the active electronic circuit comprises an active equalization device adapted to improve quality of signals transmitted from the first electrical connector to the second electrical connector, wherein the active equalization device is powered, in operation, by the power supply line through the first and second non-signal contacts, wherein the first electrical connector is directly on the device circuit board of the first electronic component, wherein the second electrical connector is adapted to be directly connected to the first electrical connector, wherein the second cable extends directly away from the second electrical connector, wherein the second non-signal contact is solely dedicated to supply power to the active electronic circuit inside the second electrical connector from the first non-signal contact, and wherein the second and third electrical connectors prevent substantive voltage from the non-signal contacts from being carried by the cables.

11. An assembly as in claim 1 wherein the first electrical connector comprises a first ground contact connected to ground on a circuit board of the first electrical component, wherein the second electrical connector comprises a second ground contact and the third electrical connector comprises a third ground contact which are adapted to be directed connected to the first ground contact, and wherein:

when the second electrical connector is connected to the first electrical connector, a circuit path is provided from the first non-signal contact, to the second non-signal contact, to the active electronic circuit, to the second ground contact, to the first ground contact and to ground; and when the third electrical connector is connected to the first electrical connector, a circuit path is provided from the first non-signal contact, to the third non-signal contact, and either to nothing or to a capacitor and then to the third ground contact and to the first ground contact and to ground.

12. An assembly comprising:

a first electrical component comprising a power supply line from a voltage source, and a first electrical connector having a first non-signal contact connected to the power supply line and a plurality of signal contacts; and a cable assembly adapted to be connected to the first electrical connector, wherein the cable assembly comprises:

a first cable assembly having a first electrical cable with a first length and a second electrical connector at an end of the first electrical cable, wherein the second electrical connector is adapted to be directly connected to the first electrical connector, wherein the first cable extends directly away from the second electrical connector, wherein the second electrical connector comprises a plurality of signal contacts, a second non-signal contact and an active electronic circuit inside the second electrical connector connected to the second non-signal contact, wherein the active electronic circuit comprises an active equalization device adapted to improve quality of signals transmitted from the first electrical connector to the second electrical connector, and wherein the active equalization device is powered, in operation, by the power supply line of the first electrical component through the non-signal contacts, and an alternative second cable assembly comprising a second electrical cable having a shorter second length than the first electrical cable and a third electrical connector at an end of the second electrical cable, wherein the third electrical connector is adapted to be directly connected to the first electrical connector, wherein the second cable extends directly away from the third electrical connector, wherein the third electrical connector comprises a third non-signal contact connected to the first non-signal contact of the first electrical connector and a plurality of signal contacts, wherein the third electrical connector does not comprise the active equalization device such that voltage from the power supply line does not affect quality of signals transmitted from the first electrical connector to the third electrical connector, wherein the first and second cable assemblies are adapted to be alternatively connected to the first electrical connector of the first electrical component to accommodate different distances between the first electrical component and another electrical component without substantially poorer quality of signals between the electrical components and without unnecessary use of the active equalization device when the distance between the electrical components allows the relatively shorter length of the second cable to be used.

13. An assembly as in claim 12 wherein the first electrical component comprises the voltage source.

14. An assembly as in claim 12 wherein the first and second cable assemblies are adapted to be alternatively connected to the first electrical connector of the first electrical component to allow voltage from the power supply line and the first non-signal contact to be used with the first length cable and the active electronic circuit when the first cable assembly is connected to the first electrical component, or alternatively still connect the first non-signal contact to a non-signal contact in the third electrical connector but not use voltage from the power supply line and the first non-signal contact with the second shorter length cable when the second cable assembly is connected to the first electrical component.

15. An assembly as in claim 12 wherein the first electrical connector is directly on a device circuit board of the first electronic component.

16. An assembly as in claim 12 wherein the first electrical connector comprises at least a portion of a device circuit board of the first electronic component.

17. An assembly as in claim 12 wherein the second non-signal contact is solely dedicated to supply power to the active electronic circuit inside the second electrical connector, and wherein the second and third electrical connectors prevent substantive voltage from the non-signal contacts from being carried by the cables.

18. An assembly comprising:

a first electrical component comprising a power supply line from a voltage source and a first electrical connector, wherein the first electrical connector comprises a first non-signal contact connected to the power supply line and a plurality of signal contacts; and a cable assembly connected to the first electrical connector, wherein the cable assembly comprises either a first cable assembly or a second cable assembly, wherein:

the first cable assembly comprises a first electrical cable and a second electrical connector at an end of the first electrical cable, wherein the first cable comprises a first length, wherein the second electrical connector comprises a plurality of signal contacts, a second non-signal contact connected to the first non-signal contact of the first connector and the power supply line of the first electrical component, and an active electronic circuit inside the second electrical connector which is connected to the second non-signal contact, wherein the active electronic circuit comprises an active equalization device adapted to improve quality of signals transmitted from the first electrical connector to the second electrical connector, wherein the active equalization device is powered, in operation, by the power supply line of the first electrical component through the non-signal contacts, and the second cable assembly comprising a second electrical cable and a third different electrical connector at an end of the second electrical cable, wherein the second cable has a second length which is shorter than the first length of the first electrical cable, wherein the third electrical connector comprises a third non-signal contact connected to the first non-signal contact of the first electrical connector and a plurality of signal contacts, wherein the third electrical connector does not comprise an active equalization device and, thus, the third non-signal contact is not connected to an active equalization device in the second cable assembly, wherein the first and second cable assemblies are adapted to be alternatively connected to the first electrical connector of the first electrical component to allow voltage from the power supply line and the first non-signal contact to be used with the first length cable and the active equalization device when the first cable assembly is connected to the first electrical component, or alternatively connect the first non-signal contact to a non-signal contact in the third electrical connector but not use voltage from the power supply line and the first non-signal contact with the second shorter length cable assembly when the second cable assembly is connected to the first electrical component.

* * * * *